US008192558B2

(12) United States Patent
Warner

(10) Patent No.: US 8,192,558 B2
(45) Date of Patent: Jun. 5, 2012

(54) DRAIN SYSTEM FOR A WAREWASHER

(75) Inventor: Charles E. Warner, Troy, OH (US)

(73) Assignee: Premark FEG L.L.C., Wilmington, DE (US)

( * ) Notice: Subject to any disclaimer, the term of this patent is extended or adjusted under 35 U.S.C. 154(b) by 479 days.

(21) Appl. No.: 12/402,736

(22) Filed: Mar. 12, 2009

(65) Prior Publication Data

US 2009/0241993 A1 Oct. 1, 2009

Related U.S. Application Data

(60) Provisional application No. 61/040,439, filed on Mar. 28, 2008.

(51) Int. Cl.
*B08B 9/30* (2006.01)

(52) U.S. Cl. ..... 134/56 D; 134/60; 134/61; 134/186; 134/198; 137/614.11

(58) Field of Classification Search ..... 134/57 D–56 D, 134/58 D, 58 DL; 137/614.11
See application file for complete search history.

(56) References Cited

U.S. PATENT DOCUMENTS

| | | | | |
|---|---|---|---|---|
| 203,745 | A | | 5/1878 | Leverty |
| 1,511,825 | A | | 10/1924 | Burns |
| 2,142,924 | A | | 1/1939 | Stoddard |
| 2,403,526 | A | | 7/1946 | Harris |
| 2,418,366 | A | | 4/1947 | Powers |
| 2,669,240 | A | | 2/1954 | Thorson |
| 2,689,576 | A | | 9/1954 | Colstad |
| 2,722,225 | A | | 11/1955 | Carson |
| 2,842,161 | A | | 7/1958 | Hunter et al. |
| 2,907,335 | A | | 10/1959 | Abresch |
| 3,025,864 | A | | 3/1962 | Ensign |
| 3,464,437 | A | | 9/1969 | Zane |
| 4,170,049 | A | * | 10/1979 | Gilliland ..... 4/427 |
| 4,561,904 | A | * | 12/1985 | Eberhardt, Jr. ..... 134/18 |
| 4,841,581 | A | * | 6/1989 | Russell ..... 4/400 |
| 5,236,137 | A | | 8/1993 | Coogan |
| 5,383,486 | A | * | 1/1995 | Warner et al. ..... 137/15.16 |
| 5,676,319 | A | | 10/1997 | Stiggins et al. |
| 6,058,526 | A | * | 5/2000 | Parisi et al. ..... 4/688 |

* cited by examiner

*Primary Examiner* — Michael Barr
*Assistant Examiner* — Caitlin N Dunlap
(74) *Attorney, Agent, or Firm* — Thompson Hine LLP

(57) ABSTRACT

A conveyor warewasher for washing wares includes a first tank including a drain system having a drain outlet and a drain stop movable between a drain outlet closed position and a drain outlet open position. A second tank includes a drain system having a drain outlet, an associated drain path that leads to the first tank and an associated drain path stop moveable between a drain path open position and a drain path closed position. A drain control assembly includes a common drain actuator operatively connected to cause both (i) movement of the drain stop from the drain outlet closed position to the drain outlet open position and (ii) movement of the drain path stop from the drain path closed position to the drain path open position.

15 Claims, 14 Drawing Sheets

DRAIN SYSTEM FOR A WAREWASHER

CROSS-REFERENCES

This application claims the benefit of U.S. Provisional patent application Ser. No. 61/040,439 filed Mar. 28, 2008, the entirety of which is hereby incorporated by reference.

TECHNICAL FIELD

This application relates generally to warewasher systems which are used in commercial applications such as cafeterias and restaurants and, more particularly, to such a warewash system including a drain system for a secondary pumped rinse system.

BACKGROUND

Commercial warewashers commonly include a housing area which defines washing and rinsing zones for dishes, pots pans and other wares. In certain zones, water is typically pumped from a tank through a pump intake, delivered to the wares via a spraying operation and collected in the tank for re-use. In operation of a warewasher with a secondary pumped rinse system, a rinse tank may be separated from a primary wash system tank, creating a need for the ability to readily drain the secondary pumped rinse tank.

SUMMARY

In one aspect, a conveyor warewasher for washing wares includes a first spray zone and a second spray zone. The first spray zone includes multiple nozzles for spraying liquid onto wares passing through the first spray zone, and a first tank for collecting sprayed liquid. The first tank includes a drain outlet and a drain stop movable between a drain outlet closed position and a drain outlet open position. The second spray zone includes multiple nozzles for spraying liquid onto wares passing through the second spray zone, and a second tank for collecting sprayed liquid. The second tank includes a drain outlet, an associated drain path that leads to the first tank and an associated drain path stop moveable between a drain path open position and a drain path closed position. A drain control assembly includes a common drain actuator operatively connected to cause both (i) movement of the drain stop between the drain outlet closed position and the drain outlet open position and (ii) movement of the drain path stop between the drain path closed position and the drain path open position, such that upon draining of the first tank via movement of the common drain actuator, the second tank drains into the first tank along the drain path enabling liquid in the second tank to exit the drain outlet of the first tank.

In another aspect, a method is provided for handling a draining operation in a conveyor warewashing machine of the type including a first spray zone with multiple nozzles for spraying liquid onto wares, the first spray zone including a first tank for collecting sprayed liquid, the first tank including a drain outlet and a drain stop movable between a drain outlet closed position and a drain outlet open position, and a second spray zone with multiple nozzles for spraying liquid onto wares, the second spray zone including a second tank for collecting sprayed liquid. The method involves: providing a drain system in the second tank, the drain system including a drain outlet, an associated drain path that leads to the first tank and an associated drain path stop moveable between a drain path open position and a drain path closed position; and operating a common drain actuator that causes both (i) movement of the drain stop from the drain outlet closed position to the drain outlet open position and (ii) movement of the drain path stop from the drain path closed position to the drain path open position, such that upon draining of the first tank via operation of the common drain actuator, the second tank drains into the first tank along the drain path enabling liquid in the second tank to exit the drain outlet of the first tank.

In yet another aspect, a conveyor warewasher for washing wares includes a first tank including a drain system having a drain outlet and a drain stop movable between a drain outlet closed position and a drain outlet open position. A second tank includes a drain system having a drain outlet, an associated drain path that leads to the first tank and an associated drain path stop moveable between a drain path open position and a drain path closed position. A drain control assembly includes a common drain actuator operatively connected to cause both (i) movement of the drain stop from the drain outlet closed position to the drain outlet open position and (ii) movement of the drain path stop from the drain path closed position to the drain path open position.

In a further aspect, a warewasher for washing wares includes a chamber for receiving wares. The chamber has an associated liquid delivery system for spraying liquid onto wares within the chamber. A primary tank collects the sprayed liquid. A secondary tank is fluidly connected to the primary tank via a conduit. A liquid recirculation system moves liquid from the primary tank back to the liquid delivery system. A drain system is located within the primary tank. The drain system includes a well, a liquid recirculation system inlet within the well and a drain opening within the well. A drain control assembly includes a drain stopper member for closing the drain opening, a strainer connected with the drain stopper member and a valve that controls liquid flow from the conduit into the primary tank. The drain stopper member and the valve are both controlled by a drain lift linkage such that both the drain opening and an outlet of the conduit are opened and closed using the drain lift linkage.

The details of one or more embodiments are set forth in the accompanying drawings and the description below. Other features, objects, and advantages will be apparent from the description and drawings, and from the claims.

DETAILED DESCRIPTION

Figure 1:
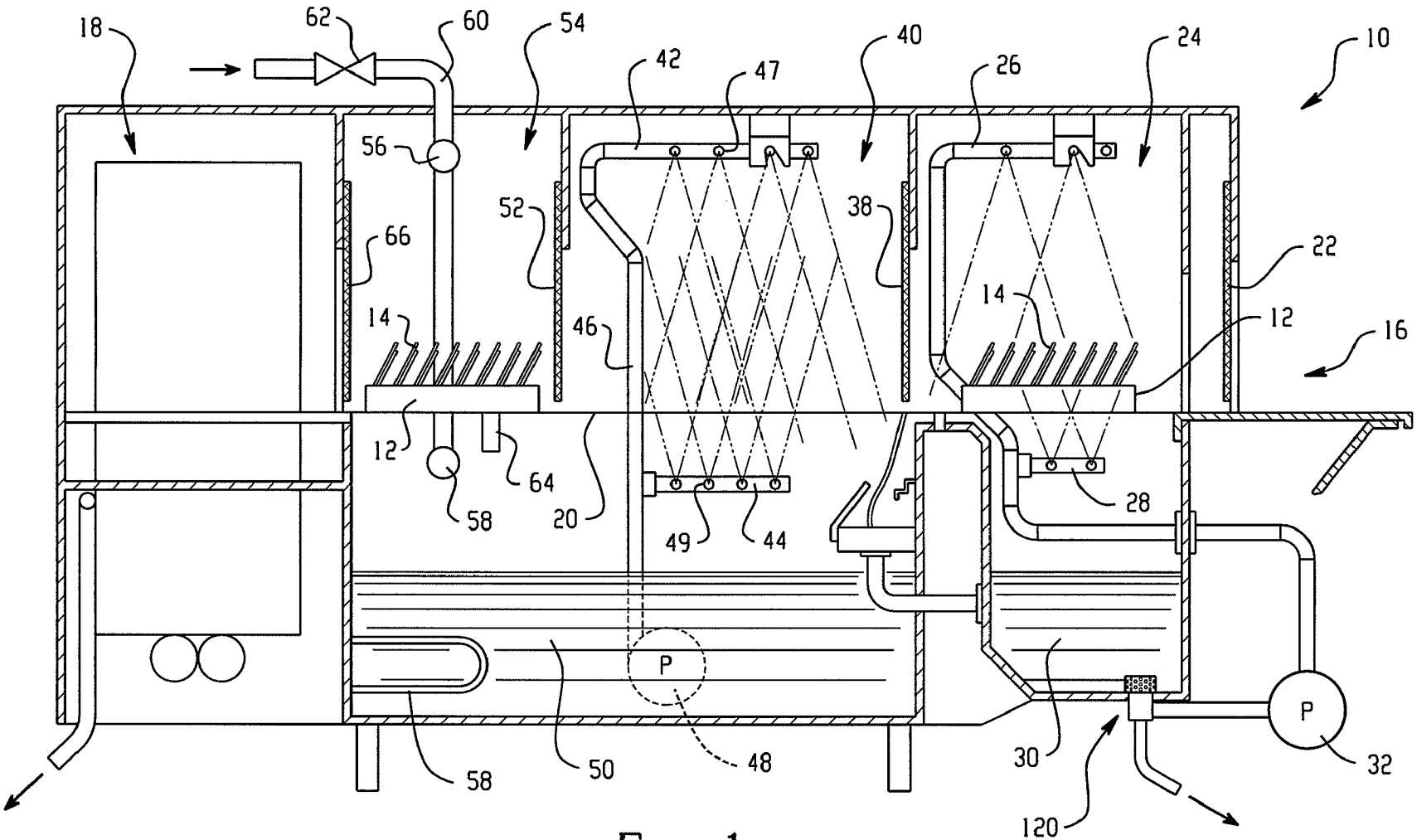
FIG. 1 is a diagrammatic side, section view of an embodiment of a warewash system.

Referring to FIG. 1, an exemplary conveyor-type warewash system, generally designated 10, is shown. Warewash system 10 can receive racks 12 of soiled wares 14 from an input side 16 which are moved through tunnel-like chambers from the input side toward a dryer unit 18 at an opposite end of the warewash system by a suitable conveyor mechanism 20. Either continuously or intermittently moving conveyor mechanisms or combinations thereof may be used, depending, for example, on the style, model and size of the warewash system 10. The conveyor machine includes multiple spray zones for cleaning the wares passing therethrough. In the illustrated embodiment, the racks 12 of soiled wares 14 enter the warewash system 10 through a flexible curtain 22 into a pre-wash chamber or zone 24 where sprays of liquid from upper and lower pre-wash manifolds 26 and 28 above and below the racks, respectively, function to flush heavier soil from the wares. The liquid for this purpose comes from a tank 30 via a pump 32 and supply conduit 34. As will be described below, a drain system 120 provides a single location where liquid is pumped from the tank 30 using the pump 32 and where liquid can be drained from the tank, for example, for a tank cleaning operation.

The racks proceed to a next curtain 38 into a main wash chamber or zone 40, where the wares are subject to sprays of cleansing liquid from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse chamber or zone (not shown in FIG. 1) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 58 that are supplied with a flow of fresh hot water via pipe 60 under the control of solenoid valve 62. A rack detector 64 is actuated when rack 12 of wares 14 is positioned in the final rinse chamber 54 and through suitable electrical controls, the detector causes actuation of the solenoid valve 62 to open and admit the hot rinse water to the spray heads 56, 58. The water then drains from the wares into tank 50. The rinsed rack 12 of wares 14 then exit the final rinse chamber 54 through curtain 66, moving into dryer unit 18.

Figure 2:
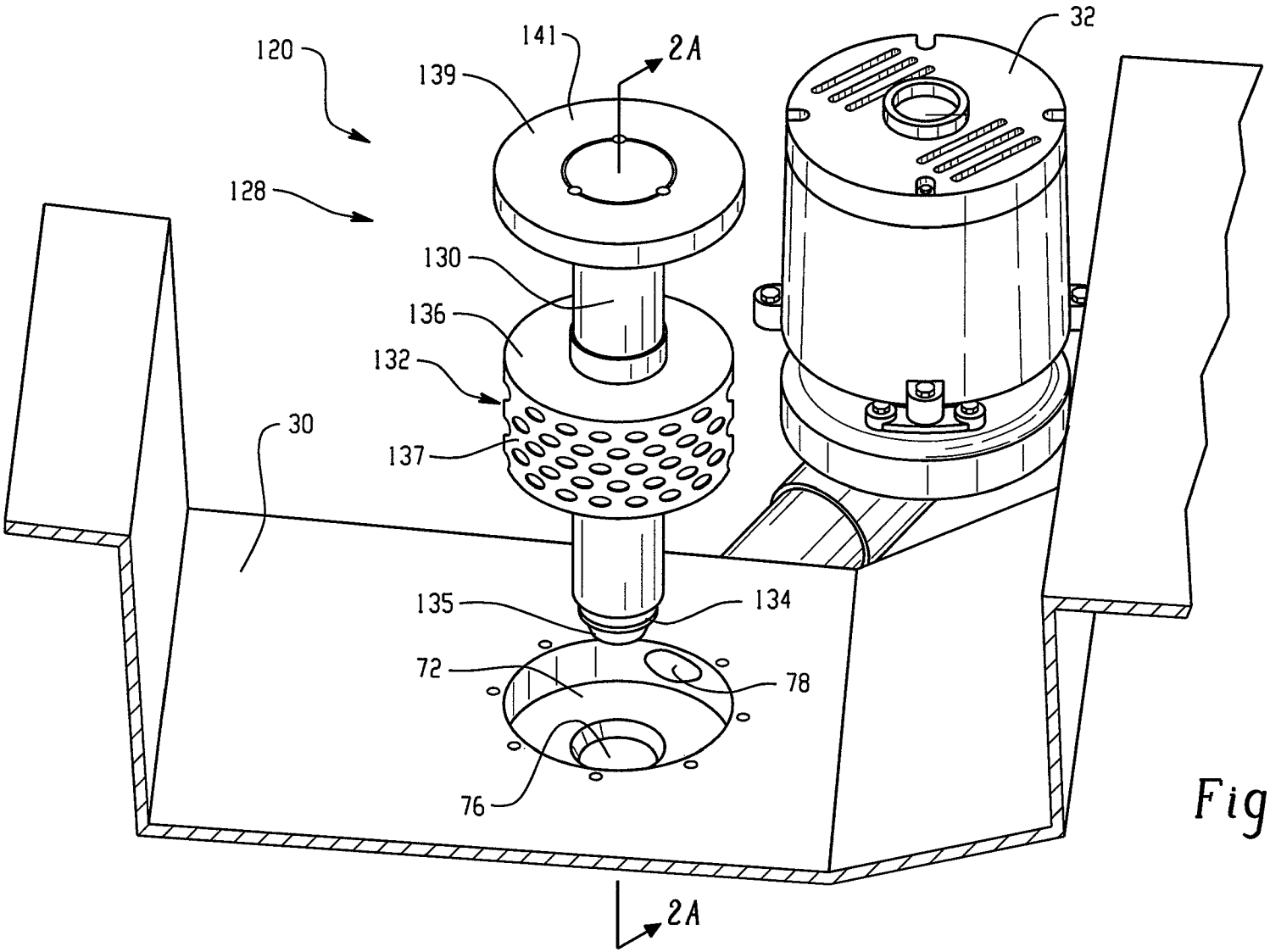
FIGS. 2-6 are various views of another embodiment of a drain system.

FIGS. 2-6 illustrate a drain system embodiment 120 for use with the tank 30 including pump inlet 78 and drain port 76 that are both in communication with well 72. A drain control assembly 128 is used to control draining of liquid from the tank 30. The drain control assembly 128 includes a support member (e.g., in the form of a standpipe 130) that supports a strainer 132 thereon. FIG. 2 illustrates the drain control assembly 128 removed from the well 72. A drain plug portion 134 is located at an end of the standpipe 130, which can be positioned within the drain port 76 to prevent liquid from passing thereby. The drain plug portion 134 includes a tapered end 135 that is used to guide the drain plug portion into the drain port 76.

Figure 2A:
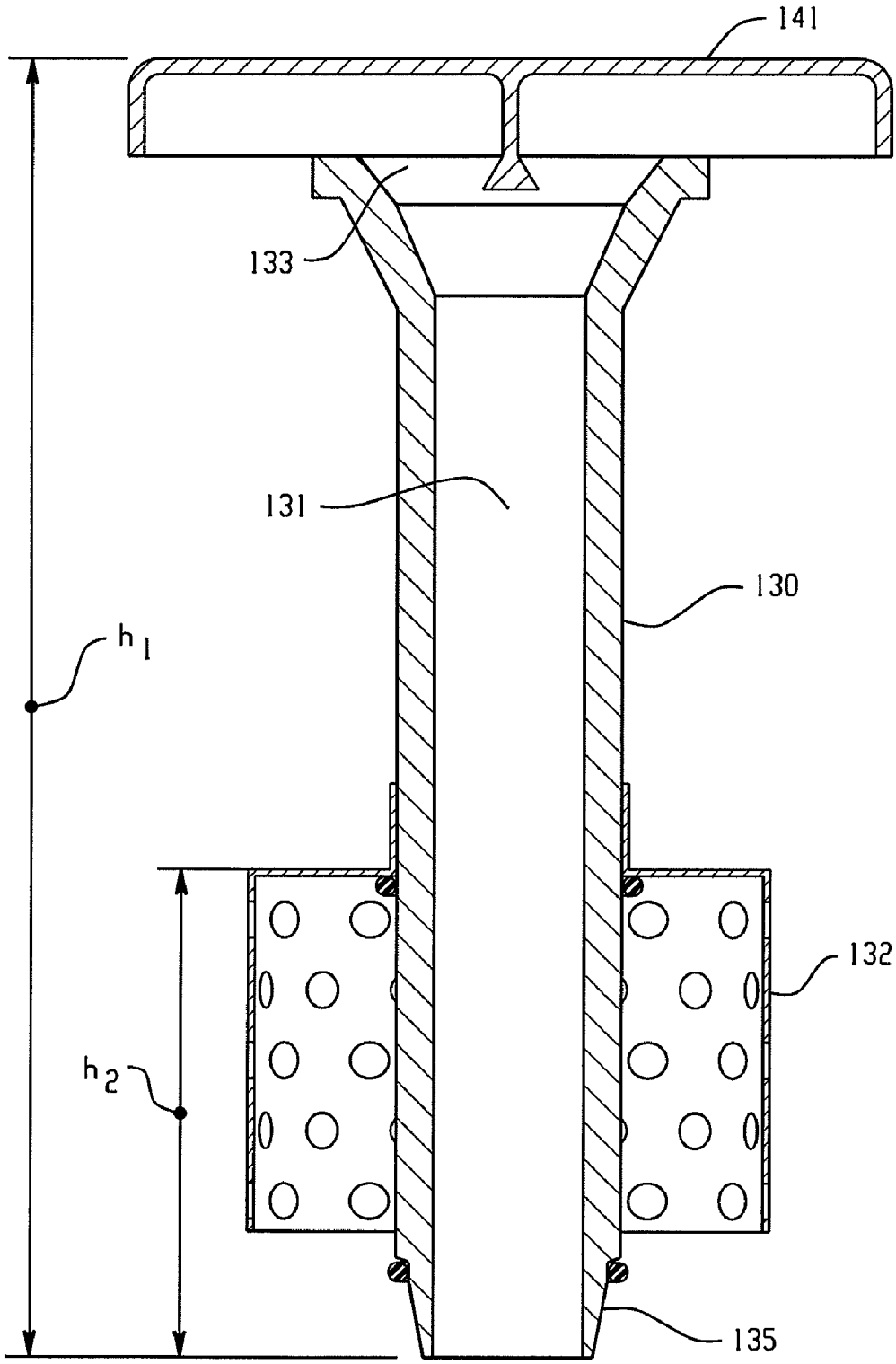

Referring briefly to FIG. 2A, the standpipe 130 includes an opening 131 extending from an upper end 133 of the standpipe through the tapered end 135. A deflector 141 may be included that is connected at the upper end 133 to the standpipe 130. The deflector 141 is spaced from the upper end 133 to allow liquid to pass therebetween during an overflow condition. The deflector 141 prevents large food particles and tableware (or other objects) from entering the opening 131.

Referring back to FIG. 2, the strainer 132 includes a wall 37 that extends about the standpipe 130 (e.g., in a cylindrical manner). The wall 37 includes openings through which liquid can pass while preventing passage of particles (e.g., large food particles) or other items such as tableware (e.g., knives, spoons, forks, etc.) thereby. A solid upper wall 136 covers a top of the wall 37. The upper wall 136 includes an opening sized to slidingly receive the standpipe 130. Other strainer shapes and configurations are contemplated. The upper wall 136 may also include strainer openings.

Figure 3:
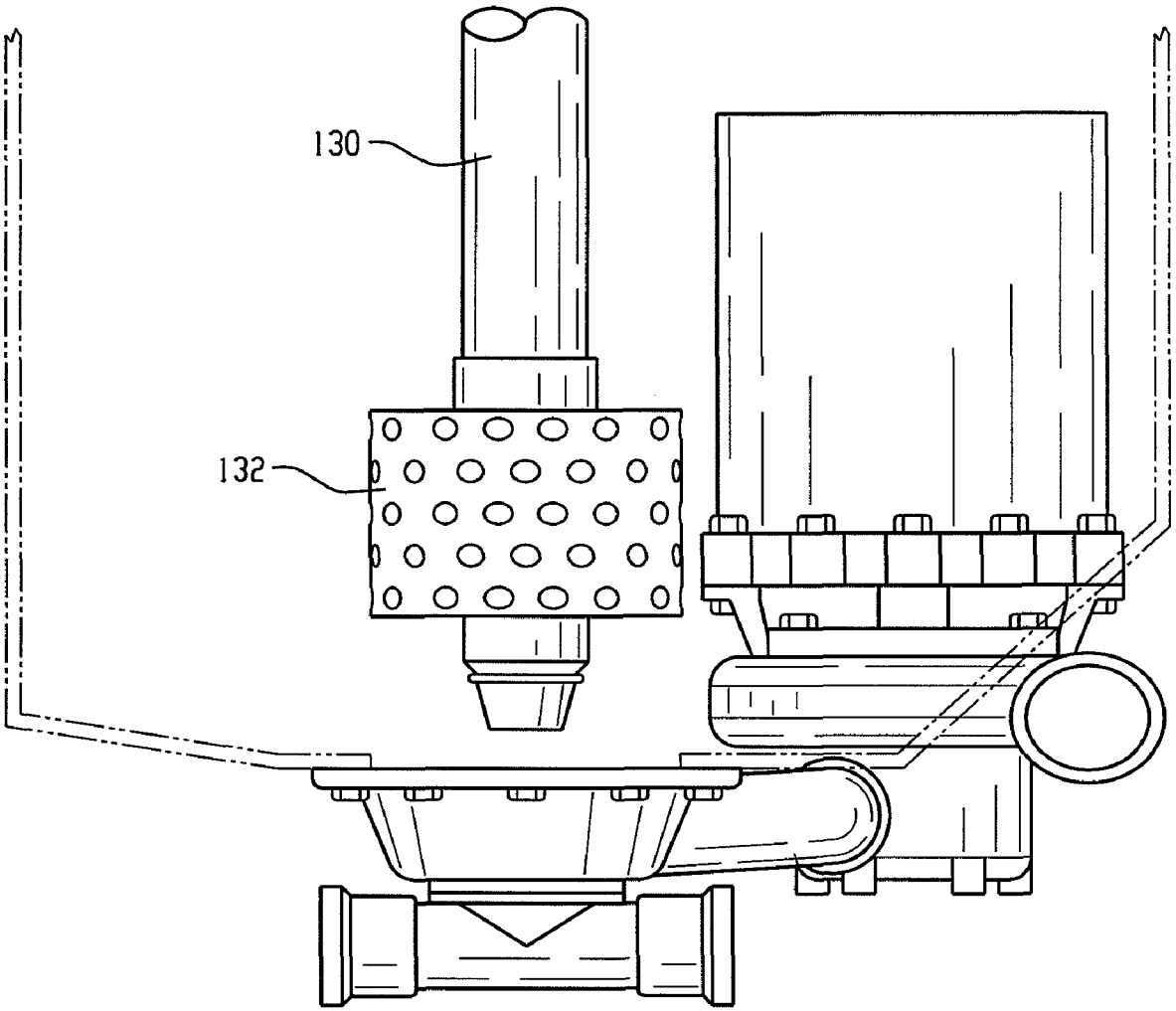
Figure 4:
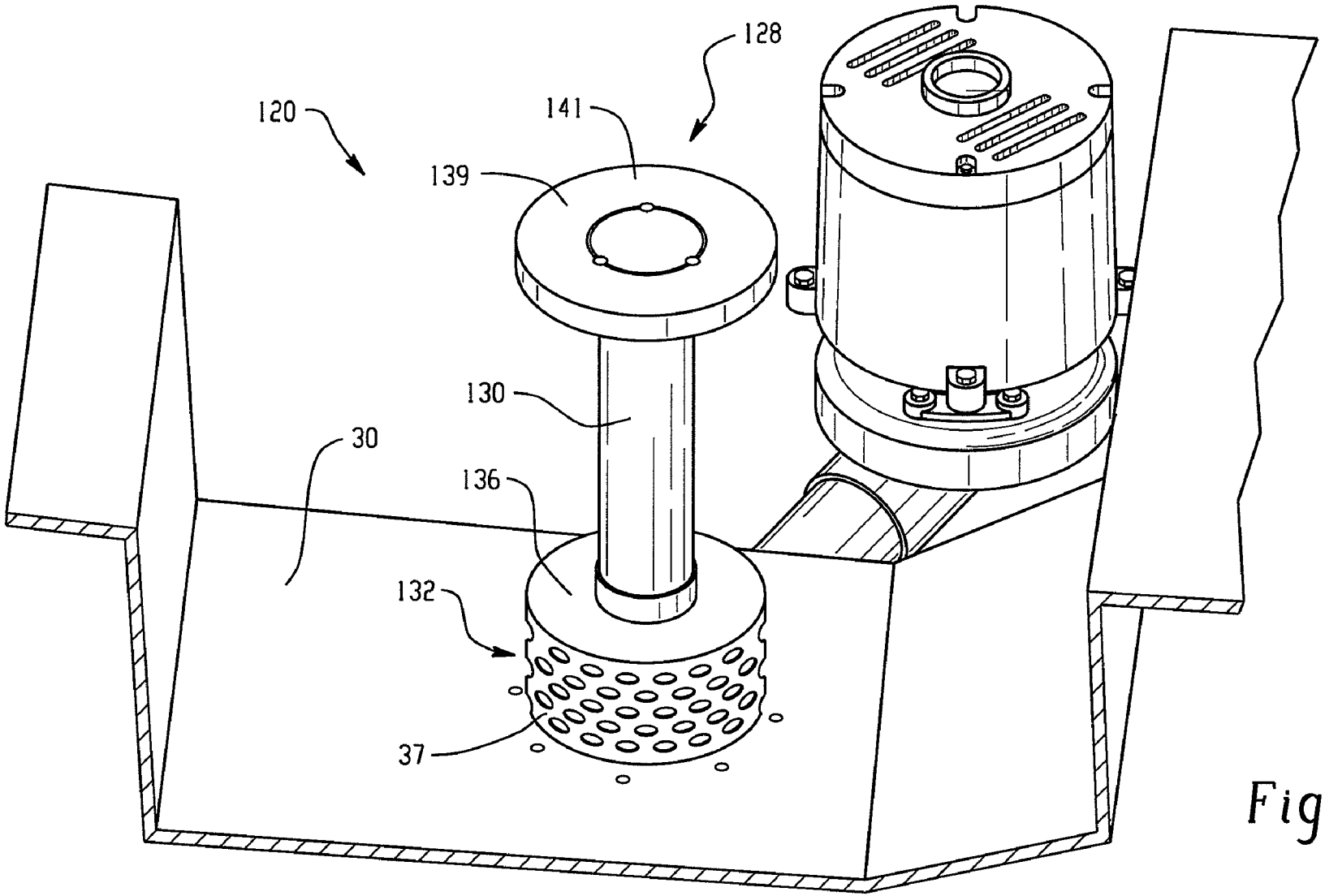

Referring now to FIG. 3, the strainer 132 and standpipe 130 are moveable relative to each other. FIG. 3 (and FIG. 2A) illustrates the strainer 132 in its fully lowered position, while FIG. 2 shows the strainer in its fully raised position relative to the standpipe 130. In some embodiments, the deflector 141 is at a height $h_1$ relative to the bottom end of the standpipe 130 that is greater than about two times (e.g., about three times or more) a height $h_2$ of the top of the strainer 132 from the bottom end of the standpipe 130 with the strainer at its fully lowered position (see FIG. 2A). Referring to FIG. 4, as the drain control assembly 128 is lowered into the well 72, the strainer 132 rests on the bottom surface of the tank 30. The combination of the tank surface and strainer 132 prevents passage of potentially obstructing items into the well 72.

Figure 5:
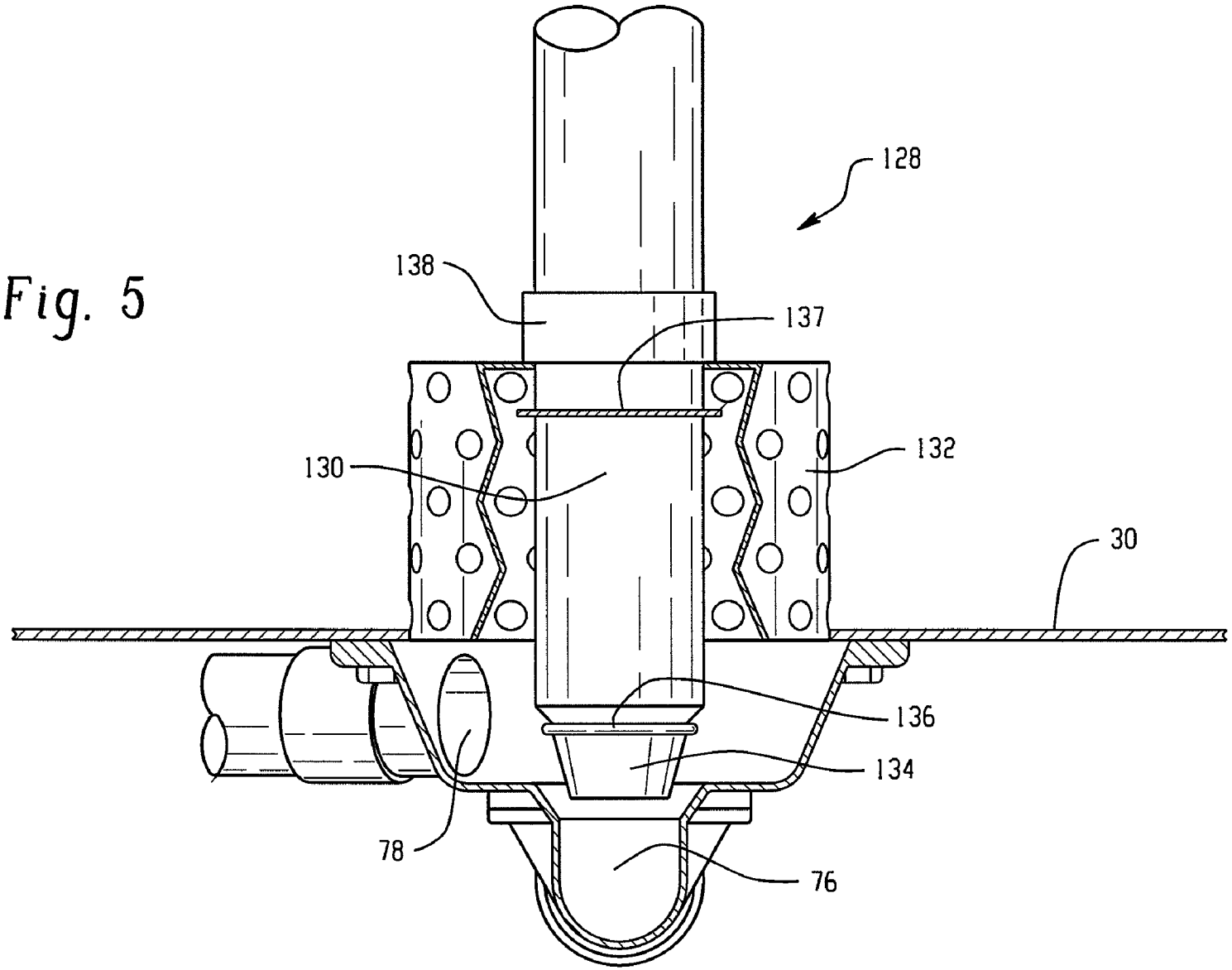

FIG. 5 illustrates the drain control assembly 128 in a configuration to allow strained liquid to drain through the drain port 76. In this configuration, the drain plug portion 134 of the standpipe 130 is lifted away from the drain port 76. The standpipe 130 may be lifted mechanically into this position and/or manually. As can be seen, in this position, the strainer 132 remains seated against the bottom of the tank 30. Thus, a user can effect tank draining by lifting the standpipe 130 slightly, without lifting the strainer 132 from its blocking position.

Figure 6:
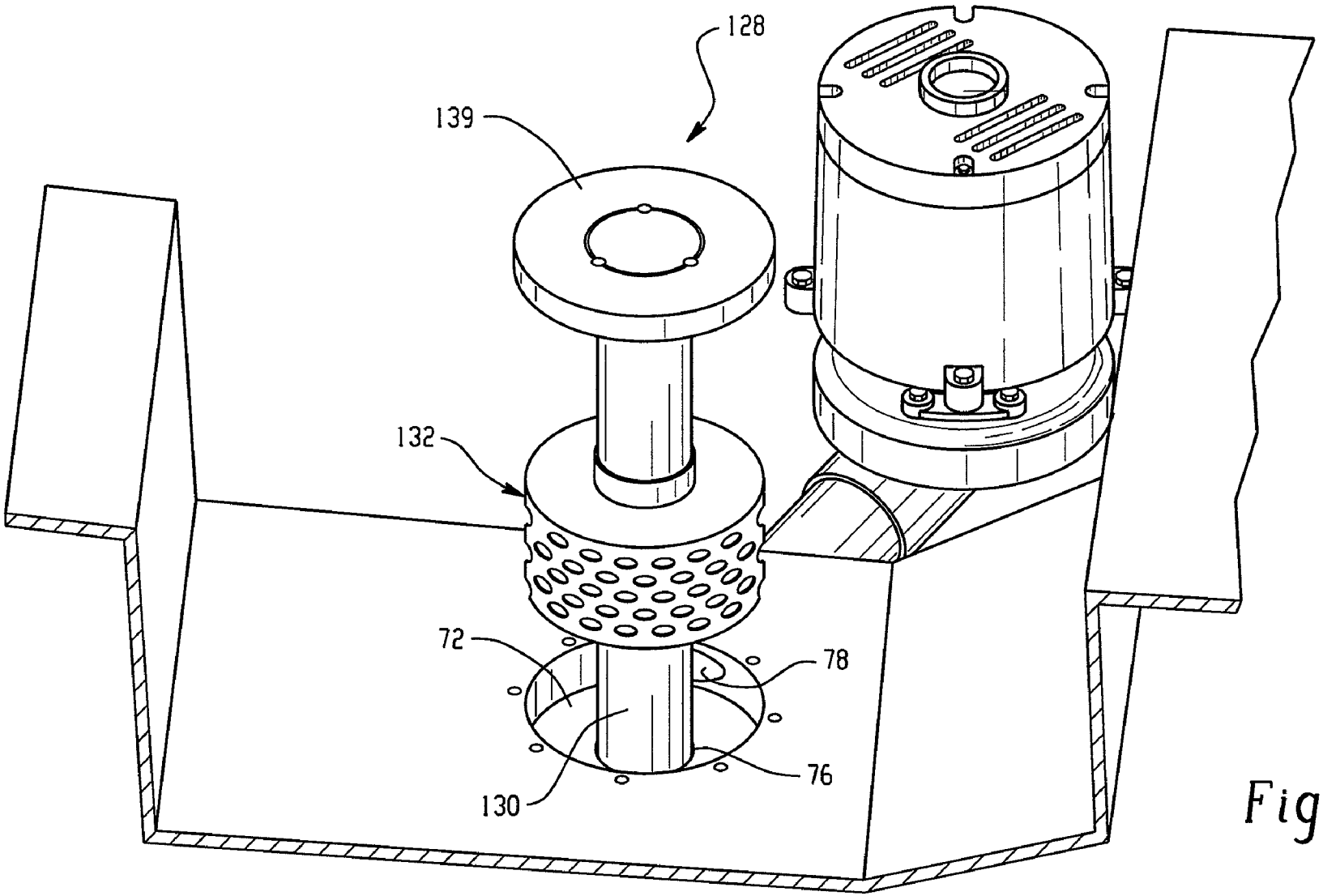

To prevent draining of liquid through the drain port 76, the standpipe 130 and drain plug portion 134 are lowered relative to the strainer 132. A seal member 136 (e.g., an O-ring) is provided on the drain plug portion 134 to provide a seal between the drain port 76 and the drain plug portion. With the drain plug portion 134 sealed with the drain port 76, filtered liquid can be drawn into the recirculation system from the well 72 and provided to the liquid delivery system while liquid is prevented from draining from the tank through the drain port. As can also be seen in FIG. 5, a stop 137 (e.g., a snap ring) is located on the standpipe 130 to prevent the strainer 132 from sliding thereby and off of the standpipe, for example, when the drain control assembly 128 is removed from the well 72 (e.g., for a cleaning operation). The stop 137 is located far enough down on the standpipe 130 to allow the standpipe to be removed from the drain port 76 while the strainer 132 remains seated against the bottom of the tank. The stop 137 may be removable to facilitate separation of the strainer 132 from the standpipe 130. There may be another stop located above the strainer 132 on the standpipe 130 to prevent the strainer from being raised off of the standpipe. In the head 139 of the standpipe there is an enlarged end that can act as a stop. FIG. 6 shows the strainer 132 in a raised position with the drain plug portion 134 located in the drain port 76.

Referring again to FIG. 5, in some embodiments, a tube member 138 is connected to the upper wall 136 of the strainer 132. The tube member 138 includes an opening through which the standpipe 130 extends. The tube member 138 interacts with the standpipe 130 to provide lateral stabilization of the strainer 132 on the standpipe. The opening of the tubular member 138 or may be free sliding.

Figure 7:
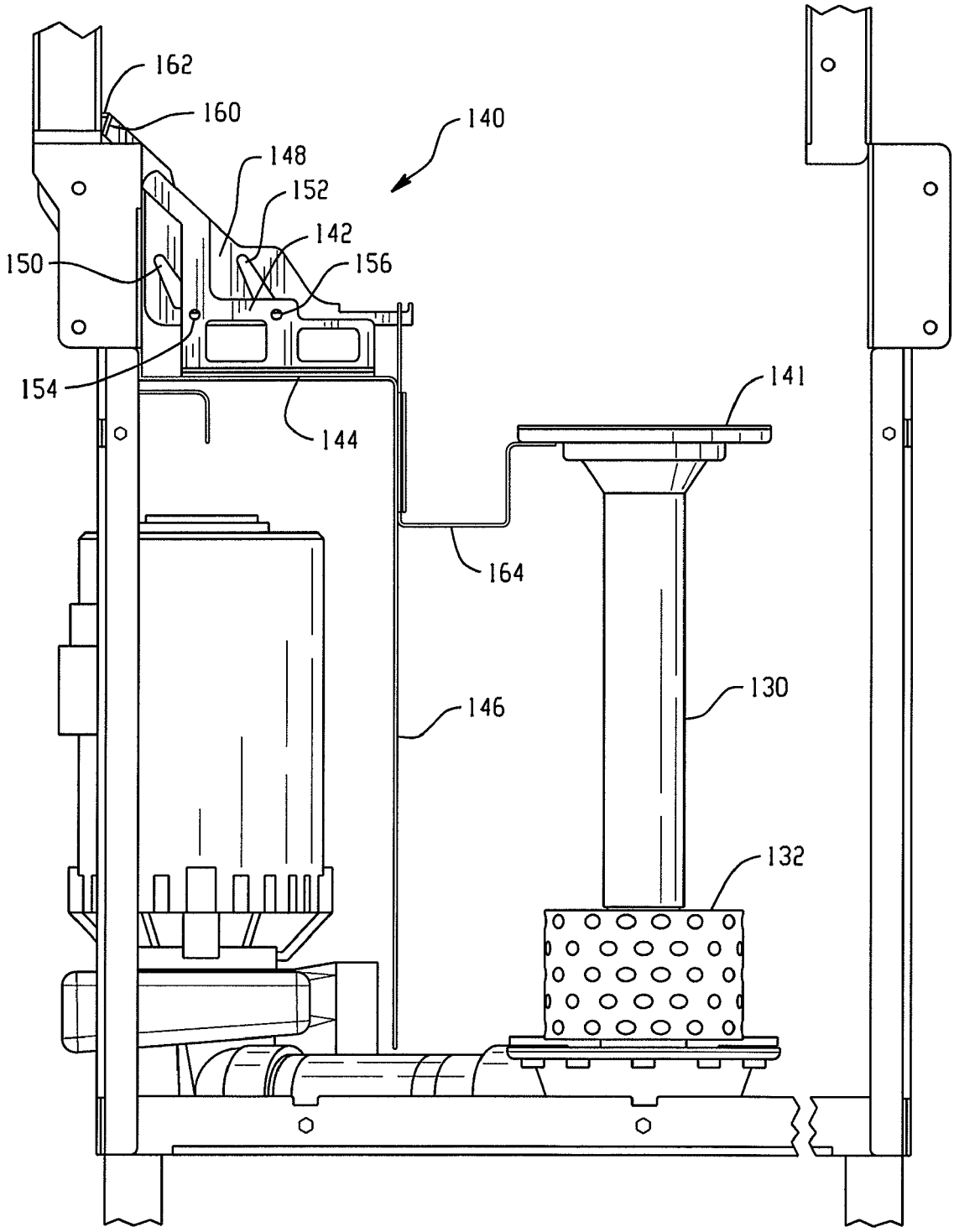
FIGS. 7 and 8 illustrate operation of a system for use in opening and closing the drain system.
Figure 8:
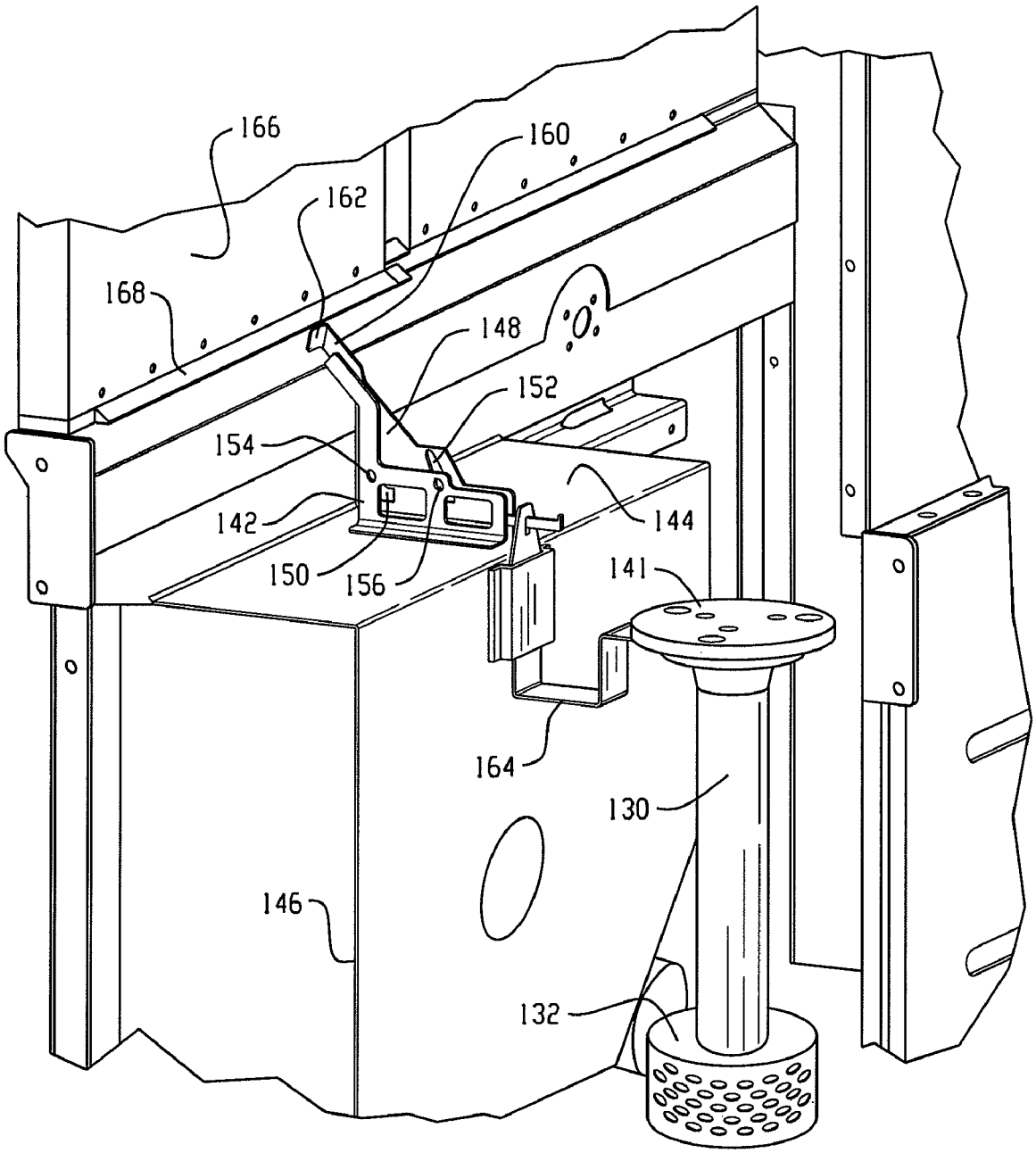

FIGS. 7 and 8 illustrate an example of a drain lift linkage 140 for use in lifting and lowering the standpipe 130. The drain lift linkage 140 includes a support bracket 142 that is mounted on an upper surface 144 of a pump housing 146. The support bracket 142 slidably supports a moveable member 148 that includes a pair of L-shaped slots 150 and 152 within which fasteners 154 and 156 are received. The moveable member 148 includes an engageable end 160 that includes a graspable portion 162 that can be grasped and pulled by an operator to lift the moveable member and pull the moveable member toward the operator. Due to the L-shape of the slots 150 and 152, the moveable member 148 can remain in the raised position until a horizontal force is applied thereto. The moveable member 148 is connected to a connector 164 that connects the standpipe 130 to the moveable member. In particular, the connector 164 is illustrated as being releasably engaged with the deflector 141, however, other configurations are possible.

FIG. 7 illustrates the standpipe 130 positioned in the raised position by the drain lift linkage 140. The slots 150 and 152 are sized such that moveable member 148 can be raised only so high (e.g., about ¾ inch) as to lift the standpipe 130 from the drain port 76 to allow liquid to pass therethrough while the strainer 132 remains seated against the bottom of the tank 30.

FIG. 8 illustrates the standpipe 130 in the lowered position, blocking the drain port 76. To place the standpipe 130 in the lowered position from the raised position, an operator can exert a horizontal force on the moveable member 148 thereby aligning the fasteners 154 and 156 with the vertical portions of the slots 150 and 152. The weight of the standpipe 130 causes the standpipe and the moveable member 148 to drop, thereby locating the standpipe within the drain port 76. In one embodiment, door 166 includes a ledge 168 that extends outwardly from the door. The ledge 168 is sized and positioned so as to contact the graspable portion 162 with the moveable member 148 in the raised position and the door 166 closed to apply the horizontal force to the moveable member to cause the standpipe to lower into its lowered position. This can prevent the standpipe 130 from being in the raised position if the door 166 is closed. The ledge 168 may also be sized so that is does not contact the graspable portion 162 with the moveable member 148 in its lowered position. The standpipe 130 and strainer 132 assembly can be removed from the drain port 76 for cleaning.

The above-described drain systems and drain control assembly can provide a number of advantages. For example, by locating both the pump intake 78 and drain port 76 within a single well, cleaning of the warewasher 10 can be simplified. Additionally, locating the pump intake 78 at the drain port 76 places the pump intake below the bottom of the tank 30 thereby increasing the head above the intake. This increase in head above the pump intake 78 can improve performance of the pump 32.

Figure 9:
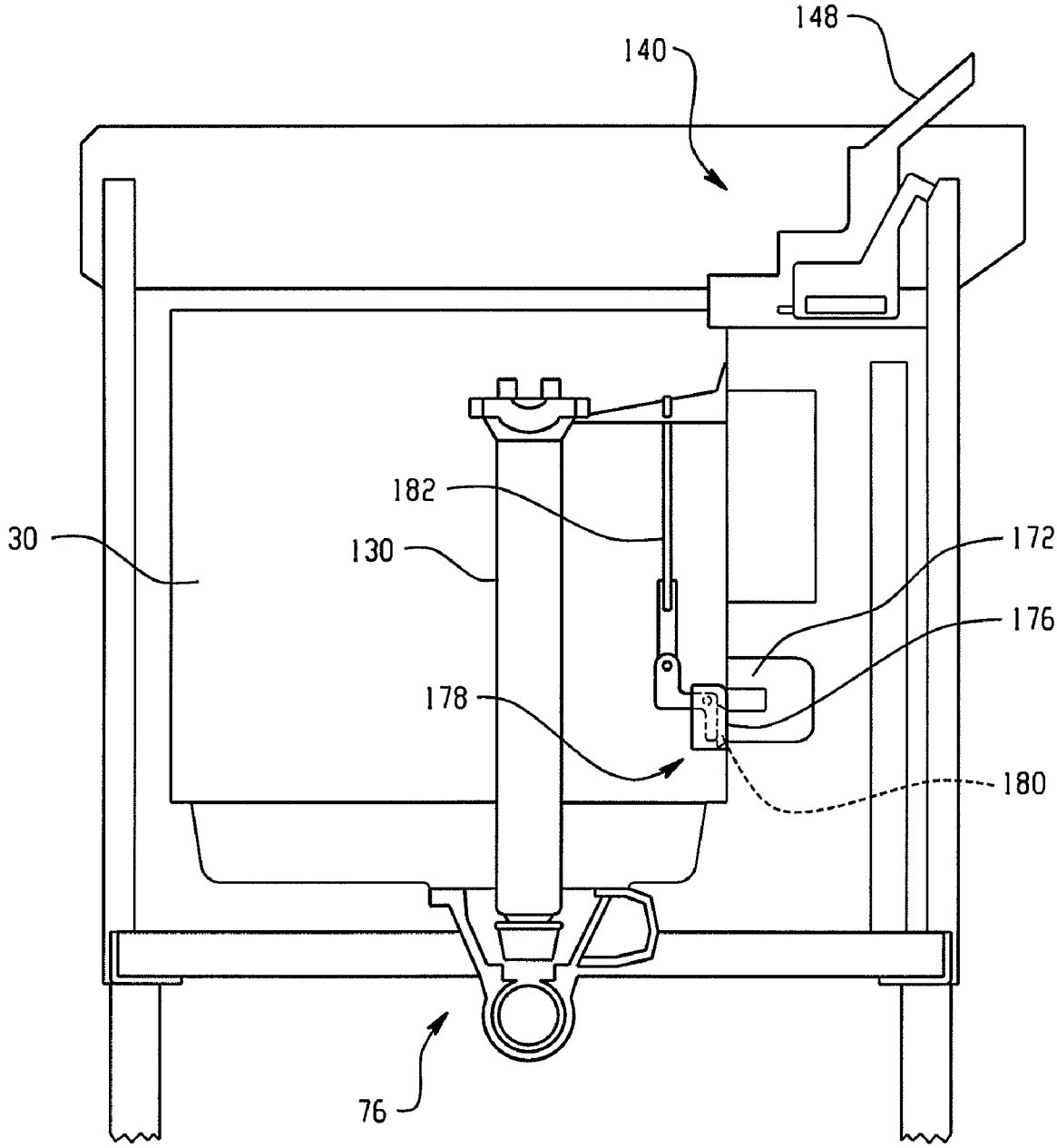
FIGS. 9-11, illustrate a drain lift linkage that is also used in draining a second tank.
Figure 10:
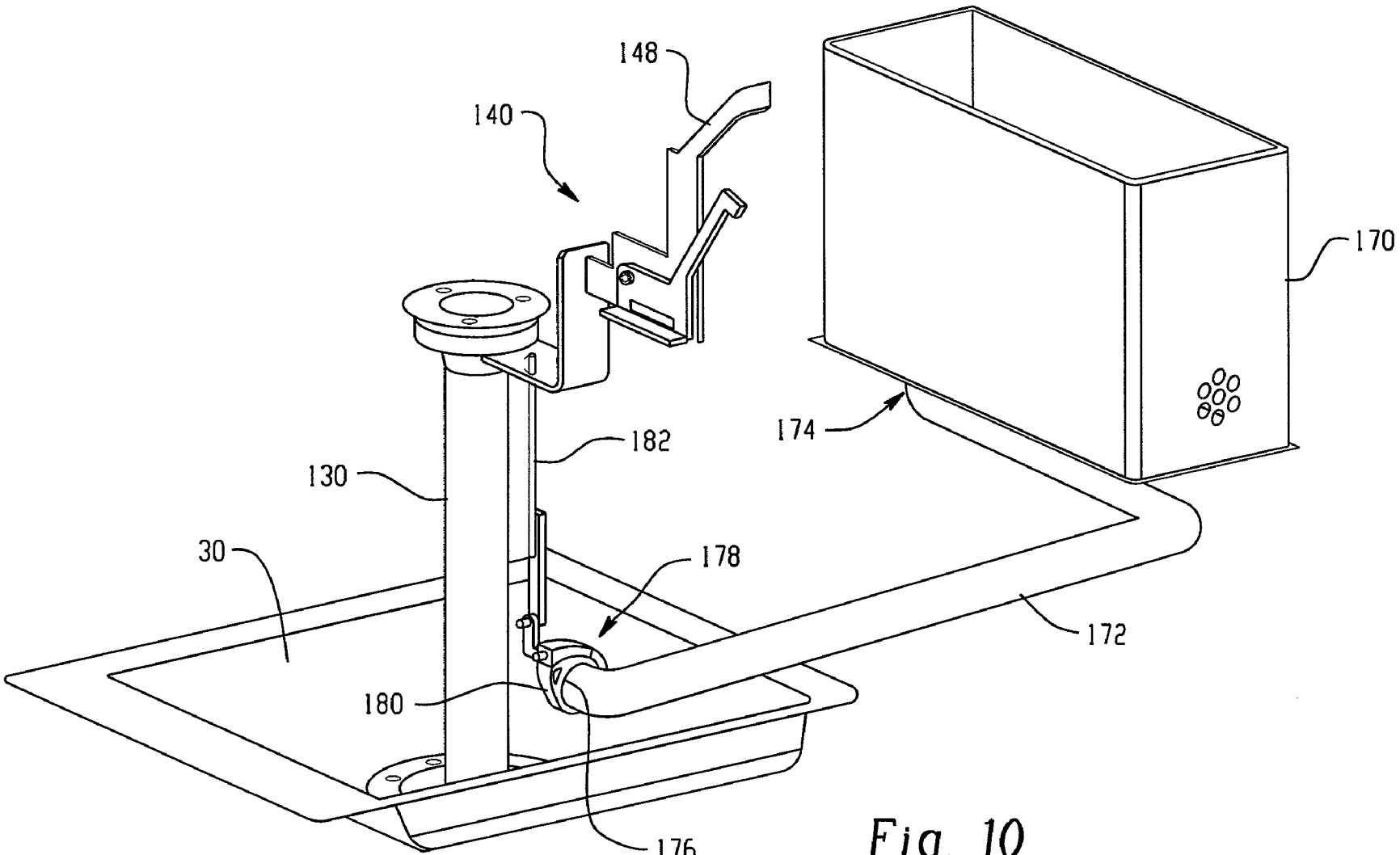
Figure 11:
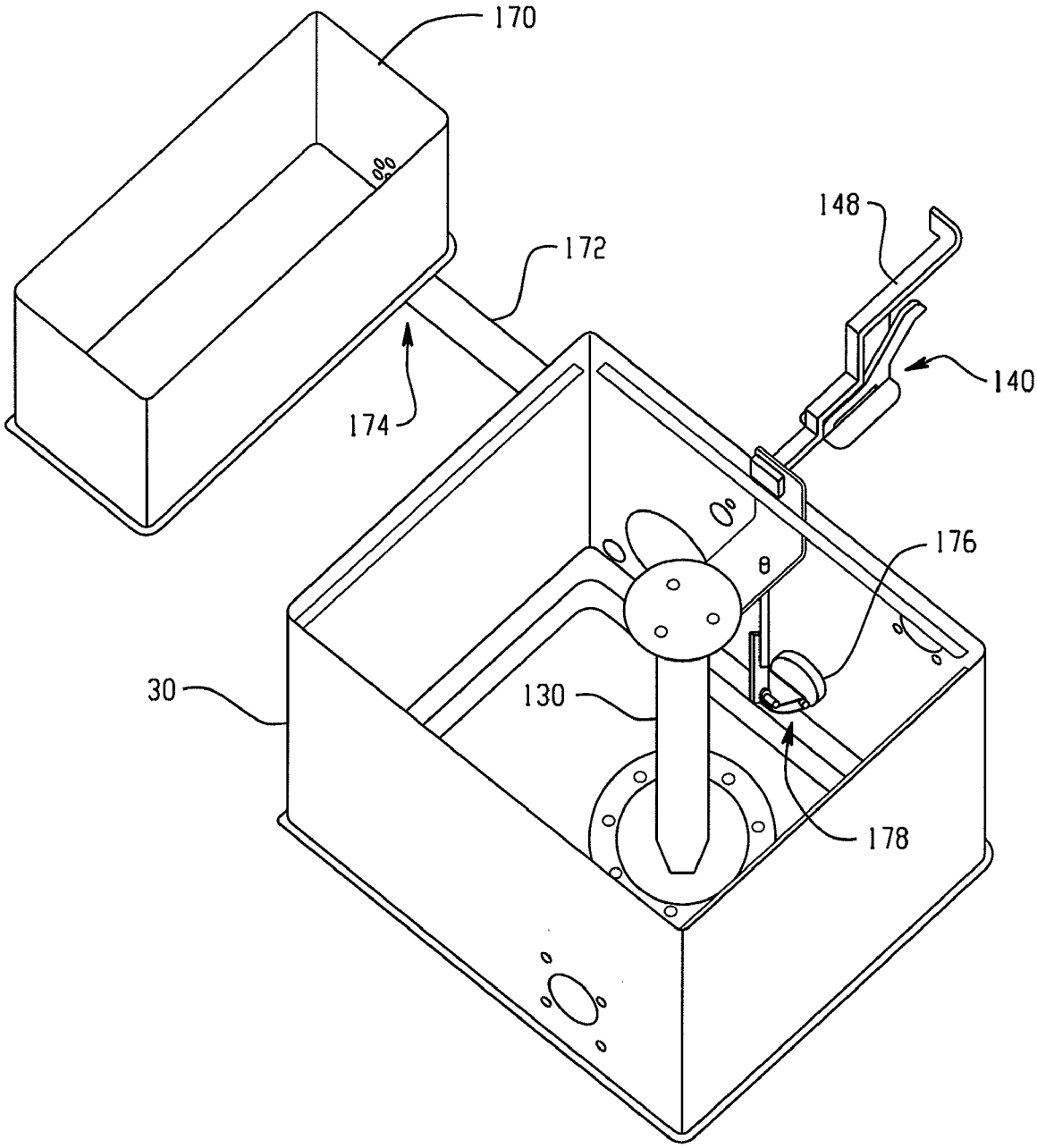

Referring now to FIGS. 9-11, the drain lift linkage 140 can also be used in draining a secondary tank 170 (of a secondary pumped rinse system). The secondary tank could also be any other tank within the conveyor machine (e.g., in some other spray zone of the machine). The secondary tank 170 is fluidly connected to the tank 30 (now referred to as primary tank 30) via a drain conduit 172 or other drain path having an inlet end 174 associated with the drain outlet of the secondary tank and through which liquid travels from the secondary tank to an outlet end 176 through which the liquid can be introduced into the primary tank. Typically, the inlet end 174 is at a higher elevation than the outlet end 176. A valve 178 (e.g., a flapper valve) acts as a drain path stop and is used to control inlet of liquid from the secondary tank 170 through the conduit 172 and into the primary tank 30. The valve 178 includes an openable member or stopper 180 that is mechanically linked via linkage 182 to the moveable member 148 of the drain lift linkage 140. Thus, moveable member 148 acts as a common actuator for both moving the standpipe 130 and drain plug 134, which acts as a drain stop of the drain outlet of the primary tank, and moving the flapper valve 178. Lifting of the moveable member 148 of the drain lift linkage 140 causes the openable member 180 to open the outlet end 176 of the conduit 172 thereby causing liquid to flow into the primary tank 30. As indicated above, the drain lift linkage 140 is also connected to the standpipe 130 such that lifting of the moveable member 148 also raises the standpipe 130 from the drain port 76 to allow liquid to pass therethrough while the strainer 132 (see FIG. 7) remains seated against the bottom of the primary tank 30. Lowering of the moveable member 148 of the drain lift linkage 140 closes the openable member 180 to prevent entry of liquid into the primary tank 30 from the conduit 172 and also lowers the standpipe 130 to seal against the drain port 76 as described above. Thus, both the secondary and the primary tanks 170 and 30 can be drained by pulling the moveable member 148 of the drain lift linkage 140. Additionally, both the valve 178 and the drain port 76 can be closed by lowering the moveable member 148, for example, through contact with the ledge 168 of the door 166, as described above.

Figure 12:
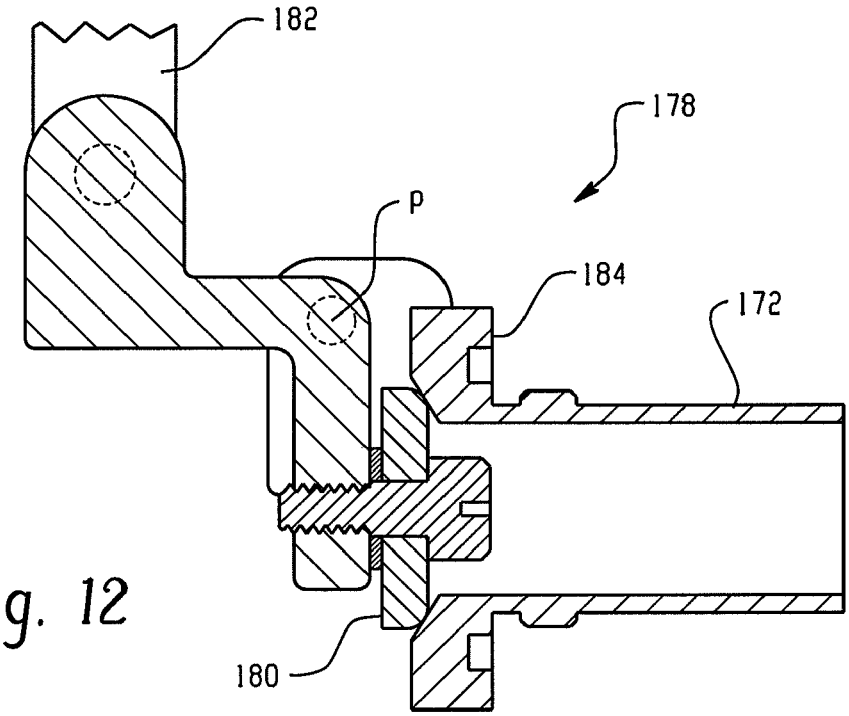
FIGS. 12 and 13 illustrate an embodiment of a valve for use in draining the second tank in closed and open positions, respectively.
Figure 13:
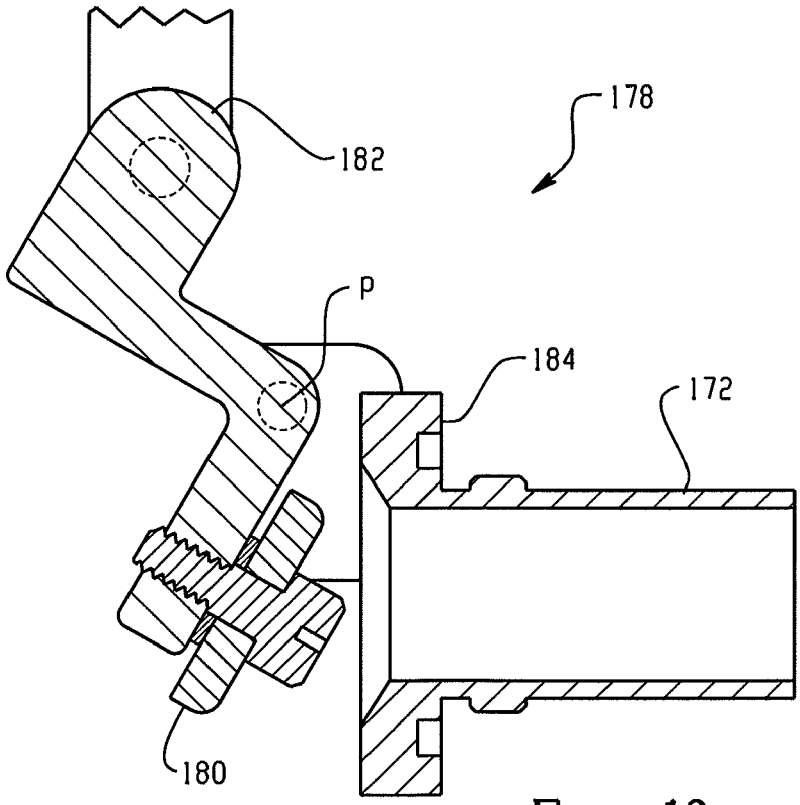

FIGS. 12 and 13 illustrate, in detail, the valve 178 in closed and open positions, respectively. In FIG. 12, the openable member 180 is seated against a seating surface 184 to form a fluid-tight seal thereby preventing liquid from entering the tank 30. In FIG. 13, the openable member 180 is lifted from the seating surface 184 by lifting the moveable member 148 and the linkage 182. The linkage 182 is pivotally connected to the openable member 180 to cause the openable member 180 to pivot about axis P when the moveable member 148 is raised. Lifting the openable member 180 from the seating surface 184 allows fluid from the secondary tank 170 to flow into the primary tank 30.

The above-described drain system can provide a number of advantages. For example, no electric power is required to drain the warewasher, thus both primary and secondary tanks 30, 170 can be drained while the warewasher's power is off. The primary and secondary tanks 30, 170 can be drained using a single moveable member 148, which acts as a common actuator, thereby requiring a single operator motion for draining both tanks. Passing liquid from the secondary tank 170 through the drain of the primary tank 30 can reduce cleaning time.

Notably, in the illustrated embodiment, when the drain plug 134 is in the drain outlet closed position (e.g., the position of FIGS. 8 and 9), drain suction in the primary tank 30 aids in maintaining the drain plug in the drain outlet closed position. When the valve member 178 is in the drain path closed position (e.g., the position of FIG. 12) the drain valve works against head pressure in the secondary tank to maintain the drain path closed. The rigid linkage 182 that connects the upper part of the standpipe to the valve 178 through the connector 164 acts such that the drain suction in the primary tank 30 acting on the drain plug 134 aids in holding the valve 178 in the drain path closed position. Also, in embodiments where, as noted above, closure of the machine door causes the actuator 148 to move out of its drain position into its non-drain position, the drain outlet of both of the tanks will be caused to close by such action.

Figure 14:
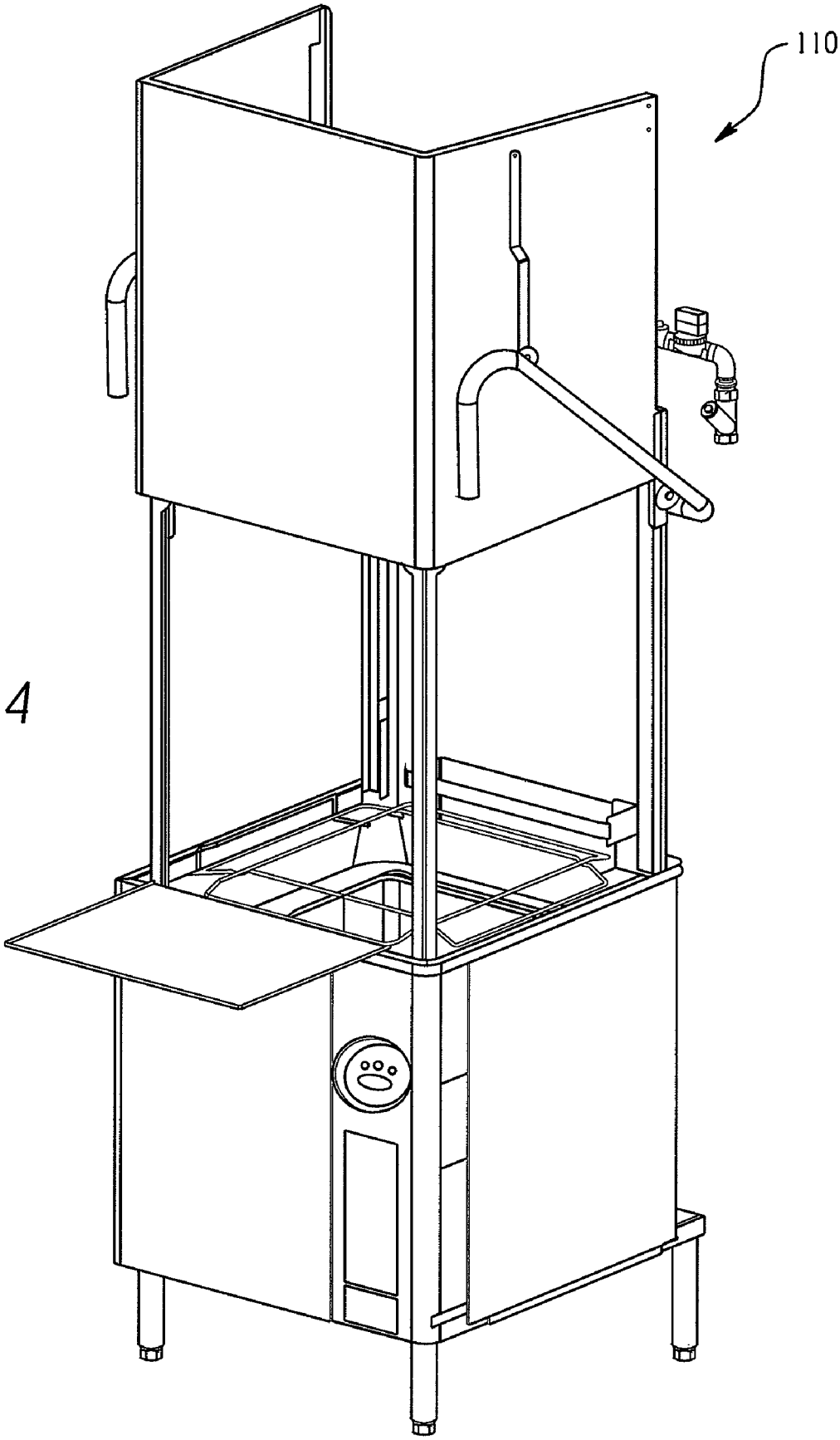
FIG. 14 is a perspective view of another embodiment of a warewasher.

It is to be clearly understood that the above description is intended by way of illustration and example only and is not intended to be taken by way of limitation, and that changes and modifications are possible. For example, rather than the manual actuator 148, a powered actuator (e.g., solenoid or motor controlled) could be provided for automated draining of both tanks. Moreover, the drain systems (represented by the dotted lines) can be utilized in non-conveyor type machines, such as warewasher 110 illustrated by FIG. 14 or an undercounter warewasher. Accordingly, other embodiments are contemplated and modifications and changes could be made without departing from the scope of this application.

What is claimed is:

1. A conveyor warewasher for washing wares, comprising:

a first spray zone with multiple nozzles for spraying liquid onto wares passing therethrough, the first spray zone including a first tank for collecting sprayed liquid, the first tank including a drain outlet at the bottom of the first tank for draining of the first tank and a drain stop movable between a drain outlet closed position and a drain outlet open position;

a second spray zone with multiple nozzles for spraying liquid onto wares passing therethrough, the second spray zone including a second tank for collecting sprayed liquid, the second tank including a drain outlet at the bottom of the second tank for draining of the second tank, an associated drain path that leads to the first tank and an associated drain path stop moveable between a drain path open position and a drain path closed position; and a drain control assembly including a common drain actuator operatively connected to cause both (i) movement of the drain stop between the drain outlet closed position and the drain outlet open position and (ii) movement of the drain path stop between the drain path closed position and the drain path open position, such that upon movement of the common drain actuator, the second tank drains into the first tank along the drain path enabling liquid in the second tank to exit the second tank into the first tank and then exit the drain outlet of the first tank.

2. The conveyor warewasher of claim 1 wherein the first spray zone is a wash zone having a recirculation system that moves wash liquid from the first tank to the nozzles of the wash zone and the second spray zone is a rinse zone including a recirculation system that moves rinse liquid from the second tank to the nozzles of the rinse zone, the rinse zone downstream of the wash zone.

3. The conveyor warewasher of claim 1 wherein the drain path stop is located at a downstream end of the drain path within the first tank.

4. The conveyor warewasher of claim 3 wherein the drain control assembly includes a drain stop lift member that vertically raises the drain stop into the drain outlet open position and a drain path stop pivot assembly that pivots the drain path stop into the drain path open position.

5. The conveyor warewasher of claim 3 wherein when the drain stop is in the drain outlet closed position drain suction in the first tank aids in maintaining the drain stop in the drain outlet closed position, and when the drain path stop is in the drain path closed position the drain path stop works against head pressure in the second tank to maintain the drain path closed.

6. The conveyor warewasher of claim 5 wherein the drain stop is linked to the drain path stop via the drain control assembly such that drain suction in the first tank acting on the drain stop aids in holding the drain path stop in the drain path closed position.

7. The conveyor warewasher of claim 1 wherein a height of the drain outlet of the second tank is above a height of than the drain outlet of the first tank, the drain path opens into the first tank at a height that is intermediate the height of the drain outlet of the second tank and the height of than the drain outlet of the first tank.

8. The conveyor warewasher of claim 1 wherein the common drain actuator comprises a manual handle.

9. The conveyor warewasher of claim 1 wherein the common drain actuator comprises a powered mechanism.

10. A conveyor warewasher for washing wares, comprising:

a first tank for collecting sprayed liquid within the warewasher, the first tank including a drain system having a drain outlet for emptying the first tank and a drain stop movable between a drain outlet closed position and a drain outlet open position;

a second tank including a drain system having a drain outlet for emptying the second tank into the first tank, an associated drain path that leads to the first tank and an associated drain path stop moveable between a drain path open position and a drain path closed position; and a drain control assembly including a common drain actuator operatively connected to cause both (i) movement of the drain stop from the drain outlet closed position to the drain outlet open position and (ii) movement of the drain path stop from the drain path closed position to the drain path open position.

11. The conveyor warewasher of claim 10 wherein the drain path stop is located at a downstream end of the drain path within the first tank.

12. The conveyor warewasher of claim 10 wherein the drain control assembly includes a drain stop lift member that vertically raises the drain stop into the drain outlet open position and a drain path stop pivot assembly that pivots the drain path stop into the drain path open position.

13. The conveyor warewasher of claim 10 wherein when in the drain stop is in the drain outlet closed position drain suction in the first tank aids in maintaining the drain stop in the drain outlet closed position, and when the drain path stop is in the drain path closed position the drain path stop works against head pressure in the second tank to maintain the drain path closed.

14. The conveyor warewasher of claim 13 wherein the drain stop is linked to the drain path stop via the drain control assembly such that drain suction in the first tank acting on the drain stop aids in holding the drain path stop in the drain path closed position.

15. A conveyor warewasher for washing wares, comprising:

a first tank for collecting sprayed liquid within the warewasher, the first tank including a drain system having a drain outlet and a drain stop movable between a drain outlet closed position and a drain outlet open position, the drain outlet positioned for draining liquid from the first tank when the drain stop is in the drain outlet open position;

a second tank including a drain system having a drain outlet positioned for draining the second tank, a drain path that leads from the drain outlet of the second tank to the first tank and a drain path stop moveable between a drain path open position and a drain path closed position, the drain outlet of the second tank positioned for draining liquid from the second tank into the first tank when the drain path stop is in the drain path open position; and a drain control assembly including a common drain actuator operatively connected to cause both (i) movement of the drain stop from the drain outlet closed position to the drain outlet open position for draining of the first tank and (ii) movement of the drain path stop from the drain path closed position to the drain path open position for draining of the second tank into the first tank.

* * * * *